US008069957B2

(12) United States Patent
Miyajima et al.

(10) Patent No.: US 8,069,957 B2
(45) Date of Patent: Dec. 6, 2011

(54) ELEVATOR DISPLAY SYSTEM PROVIDING AN INDICATION OF AN ESTIMATED ARRIVAL OF AN ELEVATOR CAR

(75) Inventors: Hiromitsu Miyajima, Sakura (JP); Kenichi Ohmura, Yotsukaido (JP); Toshimitsu Mori, Edogawaku (JP)

(73) Assignee: Otis Elevator Company, Farmington, CT (US)

( * ) Notice: Subject to any disclaimer, the term of this patent is extended or adjusted under 35 U.S.C. 154(b) by 684 days.

(21) Appl. No.: 12/159,789

(22) PCT Filed: Jan. 16, 2007

(86) PCT No.: PCT/US2007/001037

§ 371 (c)(1),
(2), (4) Date: Sep. 18, 2008

(87) PCT Pub. No.: WO2007/084459

PCT Pub. Date: Jul. 26, 2007

(65) Prior Publication Data

US 2009/0014255 A1 Jan. 15, 2009

(51) Int. Cl.
*B66B 1/34* (2006.01)

(52) U.S. Cl. ..... 187/391; 187/382

(58) Field of Classification Search ..... 187/247, 187/248, 380–388, 391–396

See application file for complete search history.

(56) References Cited

U.S. PATENT DOCUMENTS

| | | | | |
|---|---|---|---|---|
| 4,724,933 | A * | 2/1988 | Tsuji et al. | 187/398 |
| 5,042,620 | A * | 8/1991 | Yoneda et al. | 187/382 |
| 5,398,783 | A | 3/1995 | Jacoby | |
| 5,789,715 | A * | 8/1998 | Kakko et al. | 187/397 |
| 6,550,587 | B1 * | 4/2003 | Yuasa et al. | 187/394 |
| 7,040,459 | B2 * | 5/2006 | Matsuda et al. | 187/399 |
| 7,445,090 | B2 | 11/2008 | Bodmer et al. | |
| 7,591,348 | B2 * | 9/2009 | Takeuchi | 187/391 |
| 7,849,974 | B2 * | 12/2010 | Stanley et al. | 187/387 |
| 7,854,300 | B2 * | 12/2010 | Nakashima | 187/396 |
| 2004/0040791 | A1 | 3/2004 | Tyni et al. | |

FOREIGN PATENT DOCUMENTS

| | | | |
|---|---|---|---|
| EP | 0692446 | A2 | 1/1996 |
| JP | 9278300 | A | 10/1997 |
| JP | 2005162371 | A | 6/2005 |

* cited by examiner

*Primary Examiner* — Anthony Salata
(74) *Attorney, Agent, or Firm* — Carlson, Gaskey & Olds PC

(57) ABSTRACT

An elevator target floor registration unit, which displays an estimated amount of time until an assigned elevator car arrives, reduces feelings of uneasiness. Various target floor registration units by which a user may register a target floor are installed on respective floors of a building. The target floor registration units are connected to an elevator controller via an interface. The elevator controller: (a) assigns a most suitable elevator car corresponding to a user's target floor registered using the target floor registration unit; (b) computes an expected waiting time for the elevator assigned to arrive at the floor of the aforementioned registration; and (c) sends said pieces of information on the elevator assignment and the expected waiting time to aforementioned target floor registration unit in order to display them.

14 Claims, 6 Drawing Sheets

25F
ELEVATOR A
Will arrive in approximately 20sec.
32

25F
ELEVATOR A
0
10
20
30
32

25F
ELEVATOR A
32

DISPLAY IN GREEN
25F
ELEVATOR A
32

DISPLAY IN RED
25F
ELEVATOR A
32

DISPLAY IN ORANGE/YELLOW
25F
ELEVATOR A
32

DISPLAY IN GREEN
25F
ELEVATOR A
Will arrive in approximately 30sec.
32

DISPLAY IN RED
25F
ELEVATOR A
0
10
20
30
32

DISPLAY IN ORANGE/YELLOW
25F
ELEVATOR A
32

FIG.8A
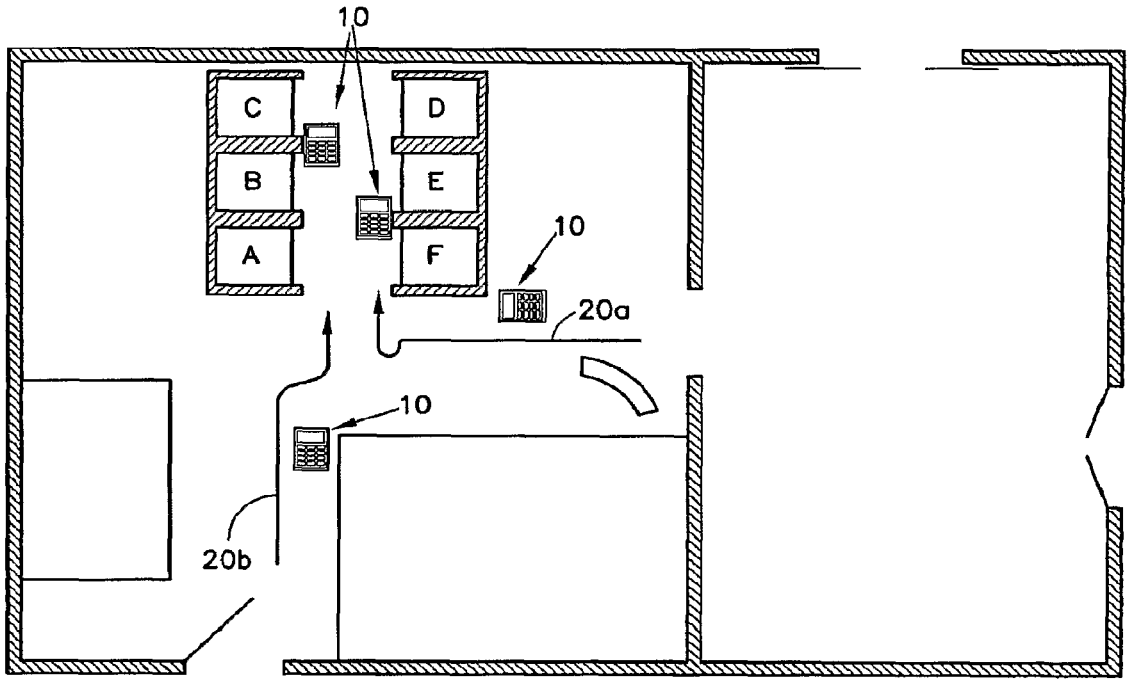
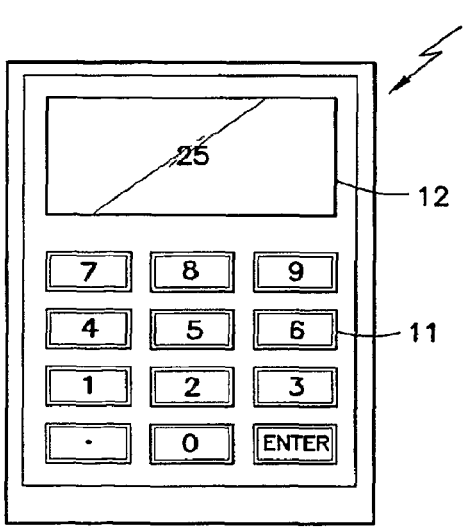
FIG.8B
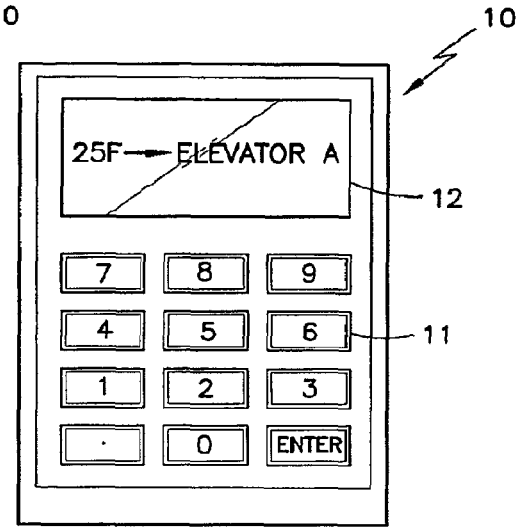
FIG.8C

ELEVATOR DISPLAY SYSTEM PROVIDING AN INDICATION OF AN ESTIMATED ARRIVAL OF AN ELEVATOR CAR

BACKGROUND

The present invention relates to an elevator display device that displays the time it takes for an elevator to arrive.

Target floor registration units that suggest a departure elevator car for a given target floor (destination floor) that a user should ride upon have been installed near elevator landings for an increasing number of elevators in recent years. Such systems are often referred to as "destination entry" systems. In such cases, the elevator system is configured in such a manner that a call for an elevator car is registered automatically, and the car travels to the target floor without requiring any actuation once the user gets in the elevator car suggested by the registration unit. For example, Japanese Kokai Patent Application No. 2001-348170 describes how a user may be led to the assigned elevator car without any confusion.

Japanese Kokai Patent Application No. 2001-348170 describes that it is feasible for target floor registration units to be installed in a building in the manner shown in FIG. 8A, which is a plan view of a floor inside a building, wherein elevator cars A-F are provided about the elevator hall. Target floor registration units 10 are installed between cars B and C and between cars E and F at the elevator hall. Furthermore, they are positioned on respective guiding lines 20*a* and 20*b* drawn on the floor in order to lead a user who is present at a prescribed distance to the elevator hall.

As shown in FIGS. 8B and 8C, each target floor registration unit 10 has a registration operation part 11 for registering a target floor using numeric keys and a display part 12 for displaying elevator information. For example, when a user registers (enters) "25" for the 25th floor as the target floor using the numeric keys as shown in FIG. 8B, the 25th floor is displayed as "25F" on the display 12, as shown in FIG. 8C. In addition, the display 12 also tells the user which car (e.g., "A") to which he/she should proceed as well as the direction (e.g., "to the left") in which he/she should walk to get to the identified car.

If the user registered a target floor at a registration unit 10 that is located at some distance from the assigned elevator car, it is plausible that the user may feel uneasy or pressured, thinking, "The elevator car may have already arrived and departed," while he/she is moving to the front of the elevator car (e.g., car A) that was displayed on the display 12. If the assigned elevator car has, in fact, already departed before the user gets to the car, the user must reregister the target floor using another target floor registration unit 10. Therefore, it would be preferable to eliminate such feelings of uneasiness for a user who uses a registration unit 10 that is located far from the elevator car identified by the registration unit.

In light of the foregoing, the present invention aims to resolve one or more of the aforementioned issues that afflict conventional elevators.

SUMMARY

An embodiment of the invention addresses an elevator display system that includes, among other possible things: a target floor registration unit; and an elevator controller. The target floor registration unit includes, among other possible things: a registration operation part that is configured to receive a target floor entered by a user; and a display part for displaying information pertaining to an assigned most suitable elevator car. The elevator controller is configured to: (a) assign the most suitable elevator car corresponding to a floor at which a user registers a target floor using the target floor registration unit; (b) compute an estimated arrival time for the assigned most suitable elevator car to arrive at the floor at which the user registered the target floor using the target floor registration unit; and (c) send information comprising the assigned most suitable elevator car and the estimated arrival time to the target floor registration unit in order to display them on the display part.

In a further embodiment of this elevator display system, if the assigned most suitable elevator car arrives at the floor at which the user registered the target floor using the target floor registration unit before the expiration of the estimated arrival time, the elevator controller may be configured to retain the assigned most suitable elevator car at the floor at which the user registered the target floor using the target floor registration unit until the estimated arrival time elapses.

In another further embodiment of this elevator display system, the display part of the target floor registration unit may be configured to change an aspect of the display according to a magnitude of the estimated arrival time. The aspect of this display may include, for example, a color and/or a picture.

Another embodiment of the invention addresses a method of controlling passenger movement through an elevator system in a building. This method includes, among other possible steps: registering, by means of a user, a target floor using a target floor registration unit; assigning a most suitable elevator car corresponding to a floor at which the user registered the target floor using the target floor registration unit; computing an estimated arrival time for the assigned most suitable elevator to arrive at the floor at which the user registered the target floor using the target floor registration unit; sending information comprising the assigned most suitable elevator car and the estimated arrival time to the target floor registration unit; and displaying the assigned most suitable elevator car and the estimated arrival time using the registration unit.

In a further embodiment of this method, the step of computing an estimated arrival time may include: multiplying an average time it takes the assigned most suitable elevator car to traverse one floor by the number of floors that the assigned most suitable elevator car must travel to reach the floor at which the user registered the target floor using the target floor registration unit, thereby defining a base time; and adding, to the base time, a set amount of time for each stop, if any, that the assigned most suitable elevator car must make while traveling to the floor at which the user registered the target floor using the target floor registration unit.

It is to be understood that both the foregoing general description and the following detailed description are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are hereafter briefly described.

FIGS. 8A-8C consist of diagrams showing an example of a conventional elevator display device, wherein FIG. 8A is a plot showing an example arrangement of target floor registration units in a building, and wherein FIGS. 8B and 8C are front views of the target floor registration unit.

DETAILED DESCRIPTION

Figure 1:
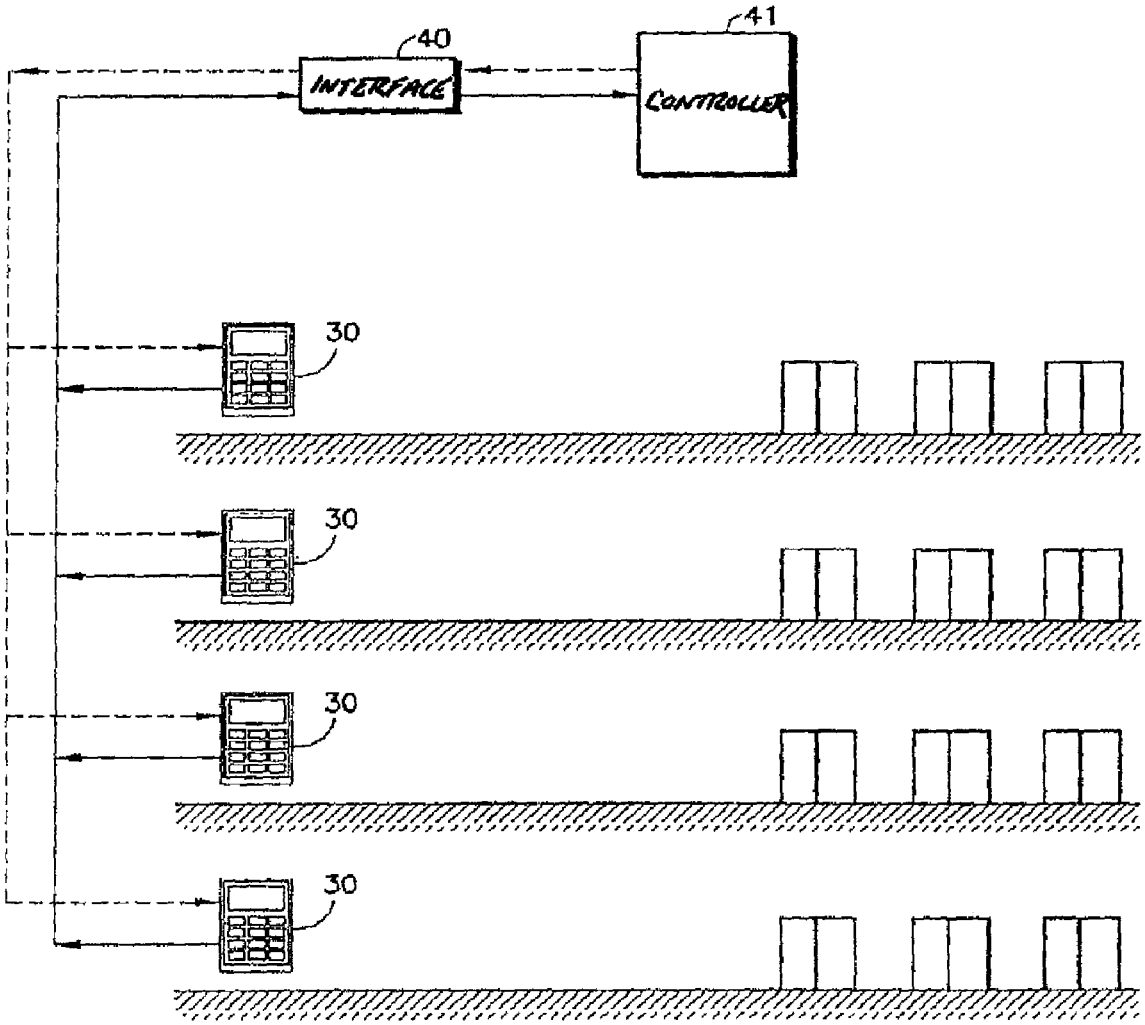
FIG. 1 is a diagram showing the overall configuration of an embodiment of the present invention.

Efforts have been made throughout the drawings to use the same or similar reference numerals for the same or like components. Various embodiments of the present invention will be explained below with reference to figures. However, the present invention is not by any means restricted to the embodiments hereafter discussed.

FIG. 1 shows the overall configuration of an embodiment of the present invention, wherein a cross-section showing conditions of respective floors in a building is shown. As shown in FIG. 1, target floor registration units 30 are installed at and/or near the elevator landings on respective floors. The target floor registration units 30 are connected to an elevator controller 41 via an interface 40. The elevator controller 41 is used to manage all the elevators in the building. When a target floor is registered using one of the target floor registration units 30, the controller 41: (a) assigns the most suitable elevator car (e.g., the elevator car that can be brought to the target floor in the shortest time possible) based on the registered target floor registration information; (b) computes a waiting time in consideration of the existing condition of the assigned elevator car as well as anticipated future events; and (c) discloses this waiting time to the user through the target floor registration unit 30 that the user used to register the target floor.

Figure 2:
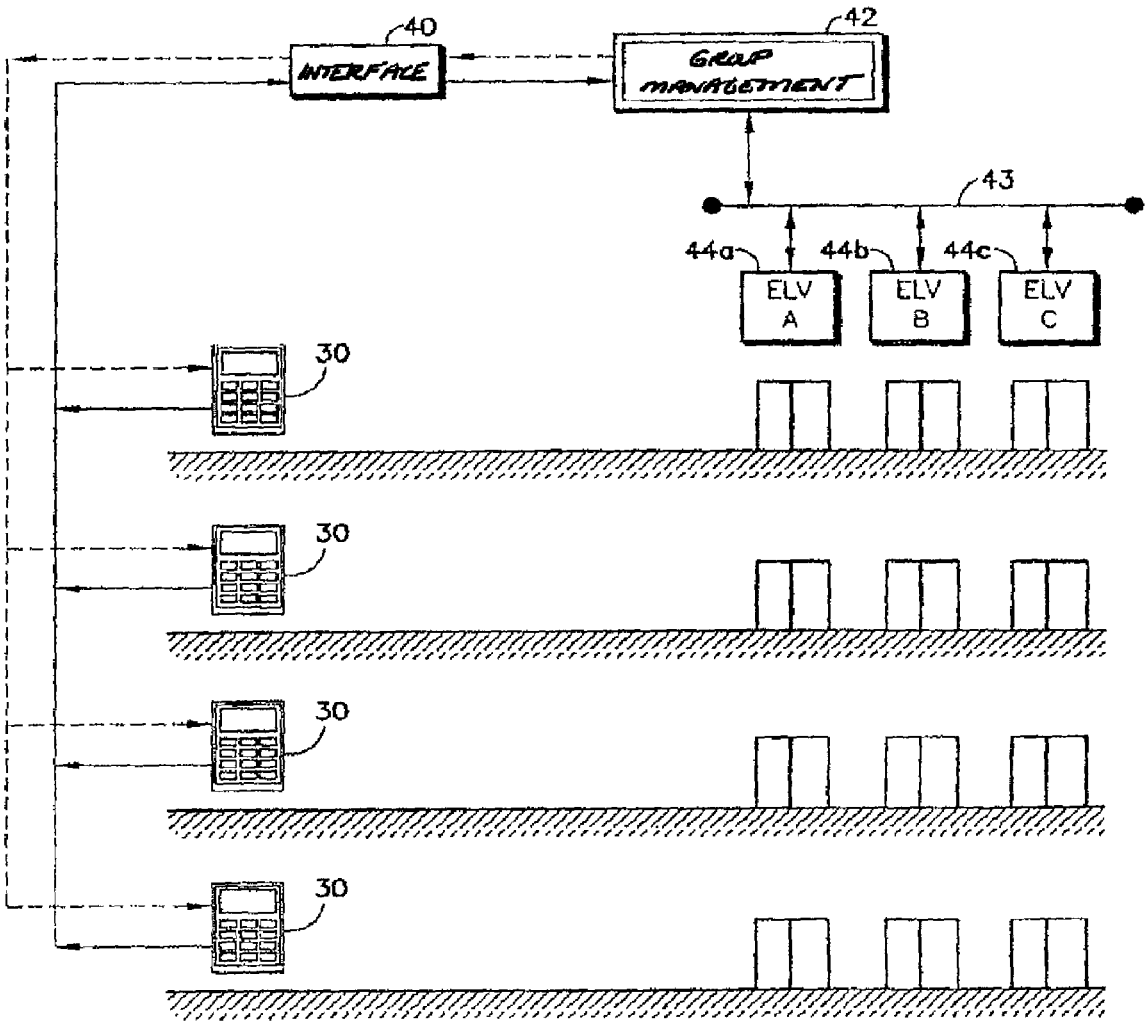
FIG. 2 is a diagram showing a specific example embodiment of the present invention.

More specifically, as shown in FIG. 2, for example, the elevator controller 41 includes a group management unit 42 and control boards 44*a*, 44*b*, and 44*c* connected to the respective elevator cars via a bus 43. Solid-line arrows in FIG. 1 and FIG. 2 indicate the flow of target floor registration information whereas broken-line arrows indicate the flow of expected waiting time information and assignment information.

Figure 3A:
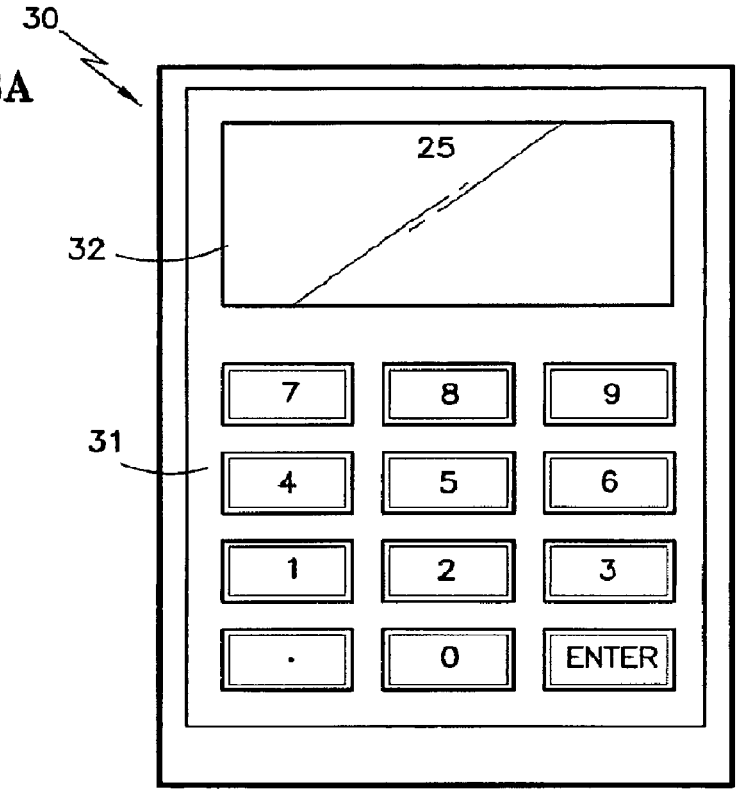
FIGS. 3A and 3B consist of front views of a target floor registration unit in the example embodiment of the present invention.
Figure 3B:
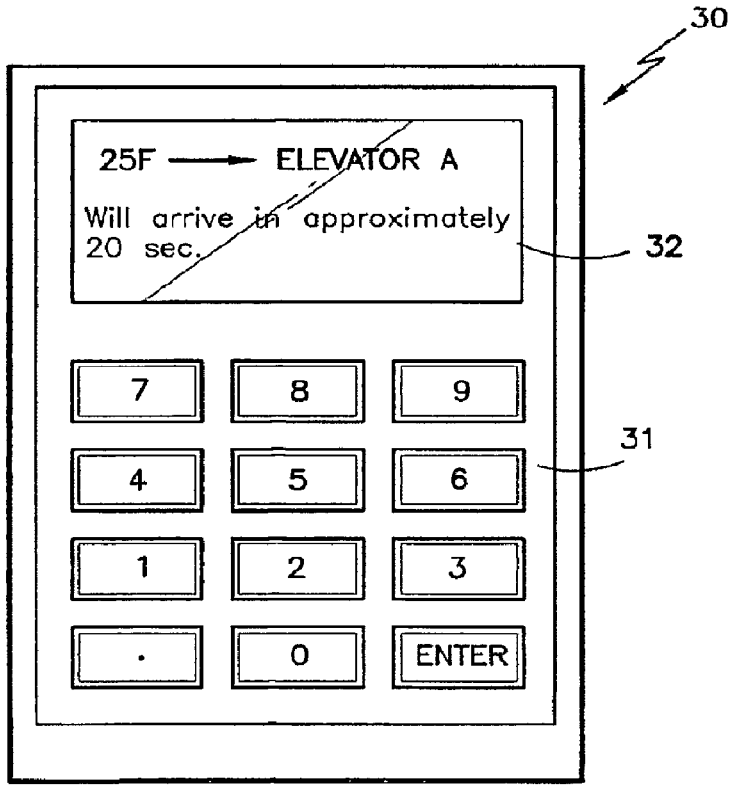

As shown in FIGS. 3A and 3B, each of the target floor registration units 30 has a registration operation part 31 for registering a target floor using numeric keys and a display part 32. The display part 32 displays pieces of information regarding the target floor, the particular elevator car assigned by elevator control unit 41, and the waiting time computed by elevator control unit 41. For example, as shown in FIG. 3A, when the user registers the 25th floor as the target floor using the numeric keys, information on the registered target floor is sent to the elevator controller 41 via the interface 40. The elevator controller 41: (a) assigns (computes) the most suitable elevator for the user; (b) computes a waiting time for the time it will take for the assigned elevator to arrive at the floor where the user is present in consideration of then existing condition of the assigned elevator as well as anticipated future events; and (c) sends the pieces of information on the expected waiting time and the assignment to the target floor registration unit 30 in order to display them.

In response, "25F" (i.e., the target 25th floor), "Elevator Car A" (i.e., the assigned elevator car), and "Will Arrive in Approximately 20 seconds" (i.e., the waiting time) are displayed on the display part 32 of the target floor registration unit 30, as shown in FIG. 3B. Due to the displayed waiting time, the user can move to the landing of the assigned elevator car without anxiety because he/she knows he/she has about 20 seconds to reach the assigned elevator car's landing. Moreover, even if the target floor registration unit 30 is installed on a guiding line 20*a* located some distance away from the elevator hall (i.e., in the manner shown in FIG. 8) and the user has used the target floor registration unit 30 to perform the registration, he/she can easily move to the front of the assigned elevator car without exceeding the displayed waiting time.

Figure 4:
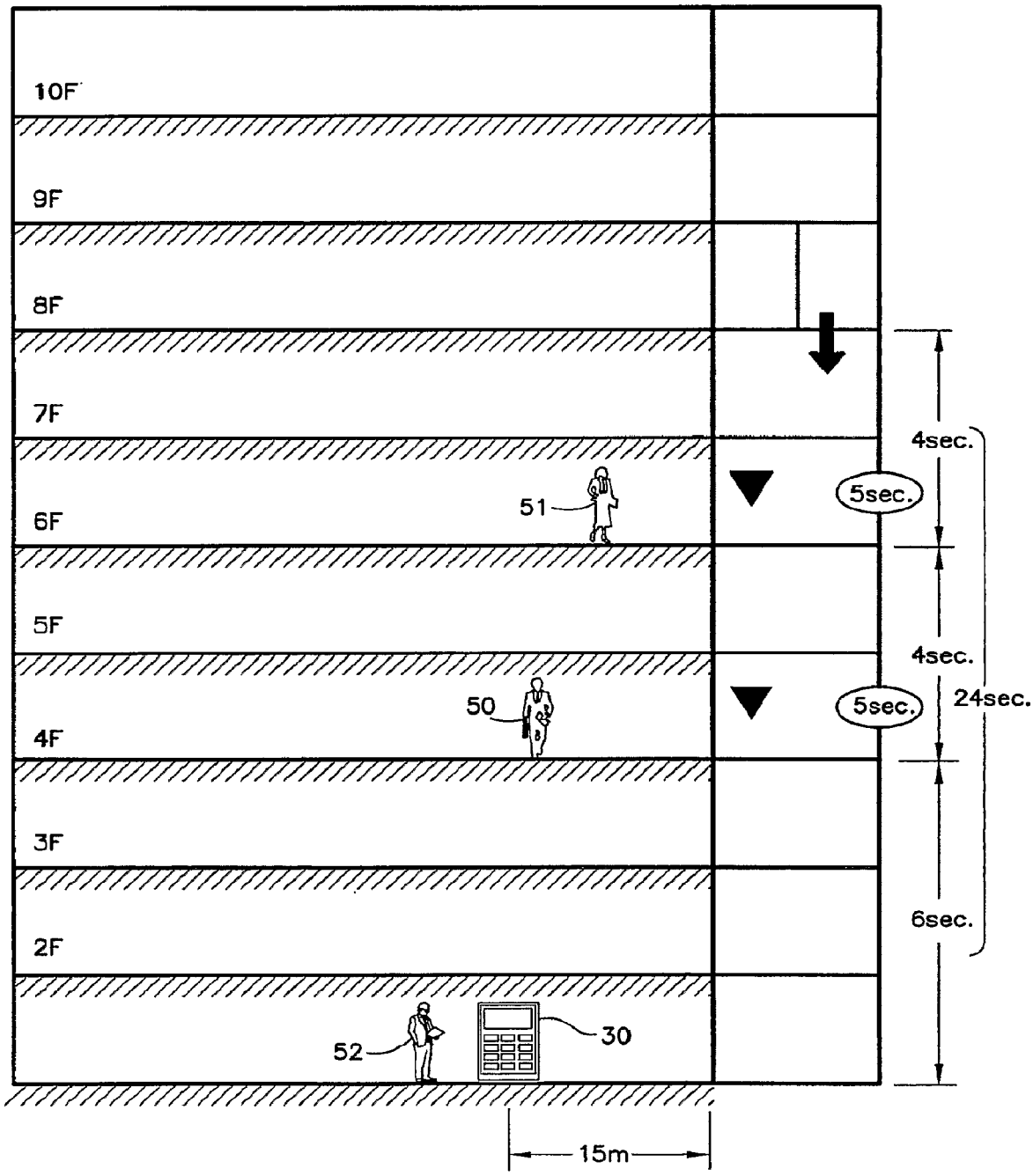
FIG. 4 is a diagram to explain an example of the computation of an expected waiting time in the example embodiment of the present invention.

FIG. 4 shows an example of the waiting time computation method carried out by elevator controller 41 in the present embodiment. In the shown example, two users 50, 51 who want go down are present on the 4th and the 6th floors, and a new user 52 has arrived at the lobby floor while the elevator is traveling downward from the 8th floor. If it takes an average of two seconds for the elevator car to travel one floor, it would take the car a base time of 14 seconds to reach the lobby floor (i.e., seven floors multiplied by two seconds per floor) if it did not stop to pick-up the users on the 4th and 6th floors. In addition, if it takes five seconds to pick-up a passenger, it would take a total of 10 seconds to pick-up the users 50, 51 on both the 4th and 6th floors. Accordingly, the total estimated time for the car to arrive at the lobby level is 24 seconds. The total estimated 24 seconds will be displayed to the new user 52 in the lobby by way of the display part 32 of the registration unit 30 by which the new user 52 registers his/her destination floor.

To promote visual understanding of the respective kinds of information displayed on display part 32 of the target floor registration unit 30, the expected waiting time may be presented in the form of a drawing and/or in color instead of (or in addition to) in the form of numbers. For example, although the estimated waiting time may be represented by numbers in the display part 32 as shown in FIG. 5A (which is similar to FIG. 3B), time blocks may be displayed as shown in FIG. 5B, and/or a drawing of a clock may be displayed as shown in FIG. 5C.

Figures 5A, 5B, 5C, 6A, 6B, 6C, 7A, 7B, 7C:
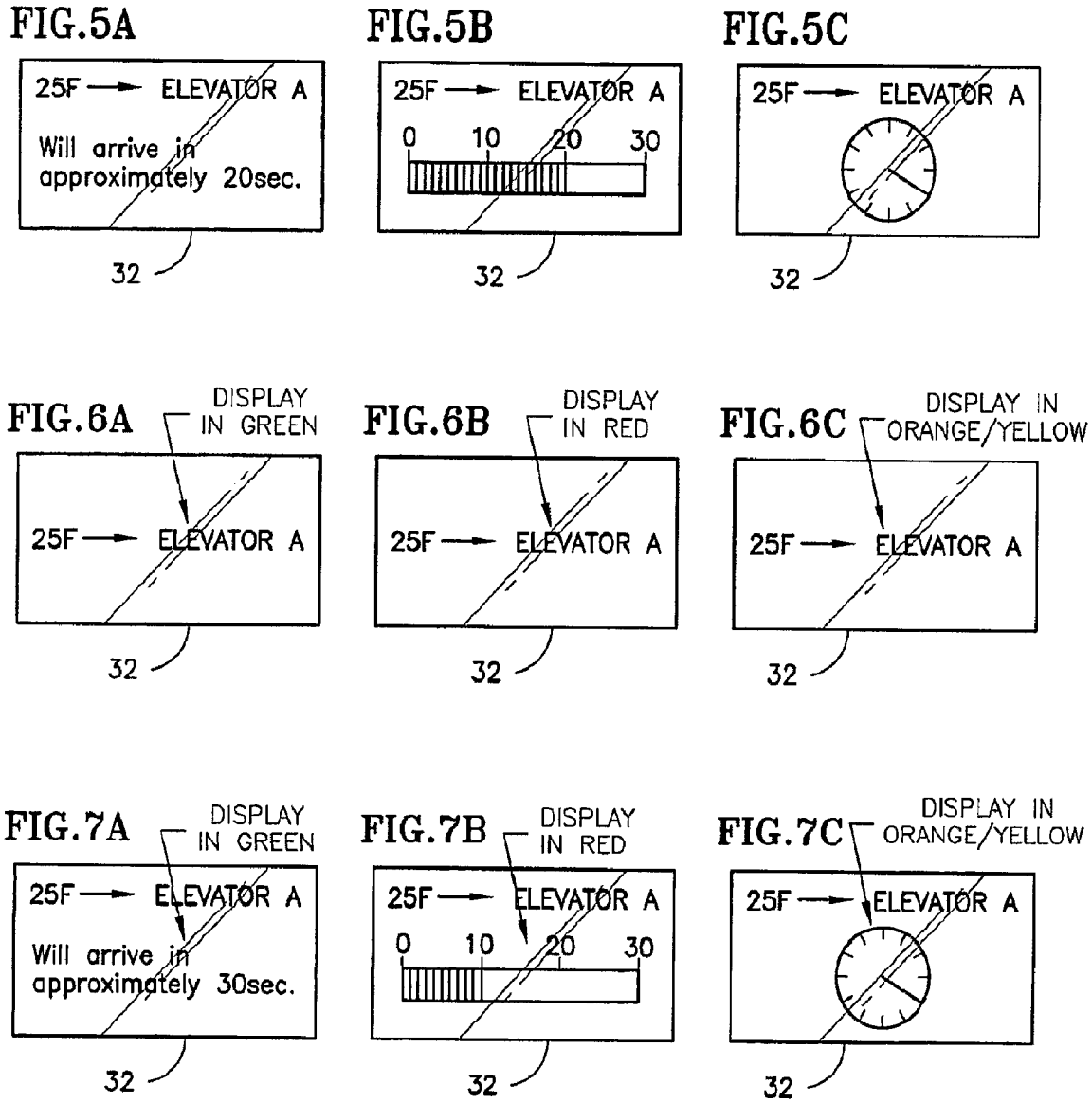
FIGS. 5A-5C consist of diagrams showing example displays of the expected waiting time in the example embodiment of the present invention.
FIGS. 6A-6C consist of diagrams showing example displays of the expected waiting time in another example embodiment of the present invention.
FIGS. 7A-7C consist of diagrams showing example displays of the expected waiting time in another example embodiment of the present invention.

In addition as shown in FIGS. 6A-6C, the color used for the display part 32 may be changed according to the amount of waiting time that remains until the assigned elevator car arrives. That is, instead of displaying the expected waiting time, the display may be presented in, e.g., green when there is plenty of time as shown in FIG. 6A, red when the user needs to hurry as shown in FIG. 6B, or orange/yellow when the user needs to move a little faster than normal as shown in FIG. 6C. When this kind of display is adopted, the user can come to know intuitively how much time he/she has before the assigned elevator car will arrive according to the color of the display. Furthermore, as shown in FIGS. 7A-7C, the display of the arrival time in FIGS. 5A-5C and the color-based display of the arrival time in FIGS. 6A-6C may be combined.

The elevator controller 41 may be configured in such a manner that if the elevator car arrives before the expected waiting time displayed by target floor registration unit 32, the controller 41 will retain the elevator at the floor with the doors open or closed until the estimated waiting time is reached.

When control is carried out in the aforementioned manner, the user can be assured that the car will be available as long as the expected waiting time does not expire, thereby eliminating the conventional need to reregister the target floor. In addition, the user can move to the landing without worrying whether the elevator car has already departed. Moreover, as the time required for the assigned elevator to arrive can be acknowledged at the time of registration of the target floor, any feelings of uneasiness and/or pressure that the user may otherwise experience may be eliminated (or at least reduced). Finally, the user will come to know intuitively how much time he/she has before the elevator arrives according to the color and/or picture of the display, thereby further reducing or eliminating any feelings of uneasiness and/or pressure.

This application claims priority to, and hereby incorporates by reference in its entirety, Japanese Priority Application No. JP2006-010564, which was filed on Jan. 19, 2006.

The aforementioned discussion is intended to be merely illustrative of the present invention and should not be construed as limiting the appended claims to any particular embodiment or group of embodiments. Thus, while the present invention has been described in particular detail with reference to specific exemplary embodiments thereof, it should also be appreciated that numerous modifications and changes may be made thereto without departing from the broader and intended scope of the invention as set forth in the claims that follow The specification and drawings are accordingly to be regarded in an illustrative manner and are not intended to limit the scope of the appended claims. In light of the foregoing disclosure of the present invention, one versed in the art would appreciate that there may be other embodiments and modifications within the scope of the present invention. Accordingly, all modifications attainable by one versed in the art from the present disclosure within the scope of the present invention are to be included as further embodiments of the present invention. The scope of the present invention is to be defined as set forth in the following claims.

What is claimed is:

1. An elevator display system comprising:

a target floor registration unit, comprising:

a registration operation part that is configured to receive a target floor entered by a user; and a display part for displaying information pertaining to an assigned most suitable elevator car; and an elevator controller that is configured to: (a) assign the most suitable elevator car corresponding to a floor at which a user registers a target floor using the target floor registration unit; (b) compute an estimated arrival time for the assigned most suitable elevator car to arrive at the floor at which the user registered the target floor using the target floor registration unit; and (c) send information comprising the assigned most suitable elevator car and the estimated arrival time to the target floor registration unit in order to display them on the display part; and if the assigned most suitable elevator car arrives at the floor at which the user registered the target floor using the target floor registration unit before the expiration of the estimated arrival time, the elevator controller is configured to retain the assigned most suitable elevator car at the floor at which the user registered the target floor using the target floor registration unit until the estimated arrival time elapses.

2. The elevator display system according to claim 1, wherein the display part of the target floor registration unit is configured to change an aspect of the display according to a magnitude of the estimated arrival time.

3. The elevator display system according to claim 2, wherein the aspect comprises a color.

4. The elevator display system according to claim 2, wherein the aspect comprises a picture.

5. The elevator display system according to claim 2, wherein the aspect comprises a color and a picture.

6. The elevator display system according to claim 1, wherein the display part of the target floor registration unit is configured to change an aspect of the display according to a magnitude of the estimated arrival time.

7. The elevator display system according to claim 6, wherein the aspect is a color.

8. The elevator display system according to claim 6, wherein the aspect is a picture.

9. The elevator display system according to claim 6, wherein the aspect comprises a color and a picture.

10. A method of controlling passenger movement through an elevator system in a building, the method comprising the steps of:

registering a target floor responsive to a user using a target floor registration unit;

assigning a most suitable elevator car corresponding to a floor at which the user registered the target floor using the target floor registration unit;

computing an estimated arrival time for the assigned most suitable elevator to arrive at the floor at which the user registered the target floor using the target floor registration unit;

sending information comprising the assigned most suitable elevator car and the estimated arrival time to the target floor registration unit;

displaying the assigned most suitable elevator car and the estimated arrival time using the registration unit; and if the assigned most suitable elevator car arrives at the floor at which the user registered the target floor using the target floor registration unit before the expiration of the estimated arrival time, retaining the assigned most suitable elevator car at the floor at which the user registered the target floor using the target floor registration unit until the estimated arrival time elapses.

11. The method according to claim 10, wherein the step of computing an estimated arrival time comprises:

multiplying an average time it takes the assigned most suitable elevator car to traverse one floor by the number of floors that the assigned most suitable elevator car must travel to reach the floor at which the user registered the target floor using the target floor registration unit, thereby defining a base time; and adding, to the base time, a set amount of time for each stop, if any, that the assigned most suitable elevator car must make while traveling to the floor at which the user registered the target floor using the target floor registration unit.

12. An elevator display system comprising:

a target floor registration unit, comprising:

a registration operation part that is configured to receive a target floor entered by a user;

a display part for displaying information pertaining to an assigned most suitable elevator car; and an elevator controller that is configured to: (a) assign the most suitable elevator car corresponding to a floor at which a user registers a target floor using the target floor registration unit; (b) compute an estimated arrival time for the assigned most suitable elevator car to arrive at the floor at which the user registered the target floor using the target floor registration unit; and (c) send information comprising the assigned most suitable elevator car and the estimated arrival time to the target floor registration unit in order to display them on the display part;

wherein the display part of the target floor registration unit is configured to change an aspect of the display according to a magnitude of the estimated arrival time and the aspect comprises a color and a picture; and;

wherein if the assigned most suitable elevator car arrives at the floor at which the user registered the target floor using the target floor registration unit before the expiration of the estimated arrival time, the elevator controller is configured to retain the assigned most suitable elevator car at the floor at which the user registered the target floor using the target floor registration unit until the estimated arrival time elapses.

13. The elevator display system according to claim 12, wherein the controller is configured to determine the estimated arrival time by multiplying an average time it takes the assigned most suitable elevator car to traverse one floor by the number of floors that the assigned most suitable elevator car must travel to reach the floor at which the user registered the target floor using the target floor registration unit, thereby defining a base time; and adding, to the base time, a set amount of time for each stop, if any, that the assigned most suitable elevator car must make while traveling to the floor at which the user registered the target floor using the target floor registration unit.

14. The elevator display system according to claim 1, wherein the controller is configured to determine the estimated arrival time by multiplying an average time it takes the assigned most suitable elevator car to traverse one floor by the number of floors that the assigned most suitable elevator car must travel to reach the floor at which the user registered the target floor using the target floor registration unit, thereby defining a base time; and adding, to the base time, a set amount of time for each stop, if any, that the assigned most suitable elevator car must make while traveling to the floor at which the user registered the target floor using the target floor registration unit.

* * * * *